US006844853B2

(12) United States Patent
Tai et al.

(10) Patent No.: US 6,844,853 B2
(45) Date of Patent: Jan. 18, 2005

(54) DUAL BAND ANTENNA FOR WIRELESS COMMUNICATION

(75) Inventors: Lung-Sheng Tai, Tu-Chen (TW); Chia-Ming Kuo, Tu-chen (TW); Zhen-Da Hung, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/630,820

(22) Filed: Jul. 29, 2003

(65) Prior Publication Data

US 2004/0227665 A1 Nov. 18, 2004

(30) Foreign Application Priority Data

May 16, 2003 (TW) ..... 092113410

(51) Int. Cl.[7] ..... H01Q 1/38
(52) U.S. Cl. ..... 343/700 MS; 343/702
(58) Field of Search ..... 343/700 MS, 702, 343/829, 846, 848

(56) References Cited

U.S. PATENT DOCUMENTS 6,204,819 B1 3/2001 Hayes et al.
6,204,826 B1 3/2001 Rutkowski et al.
6,295,029 B1 * 9/2001 Chen et al. ..... 343/700 MS
6,535,172 B2 * 3/2003 Hirabayashi ..... 343/725
6,552,686 B2 * 4/2003 Ollikainen et al. .. 343/700 MS
6,606,071 B2 * 8/2003 Cheng et al. ..... 343/767
6,734,826 B1 * 5/2004 Dai et al. ..... 343/700 MS
2004/0178957 A1 * 9/2004 Chang et al. ..... 343/700 MS

OTHER PUBLICATIONS

Faton Tefiku et al. "Design of Broad–Band and Dual–Band Antennas Comprised of Series–Fed Printed–Strip Dipole Pairs", IEEE Transaction on Antenna and Propagation, vol. 48, No. 6, Jun. 2000, 895–900.

* cited by examiner

*Primary Examiner*—Tho Phan
(74) *Attorney, Agent, or Firm*—Wei Te Chung

(57) ABSTRACT

A dual band antenna (1) for a wireless communication device includes an insulative substrate (10), a feeder (40) and a conductive element (20) disposed on the substrate includes a ground portion (30), a first radiating portion (21), a second radiating portion (22), a first connecting portion (23) connecting the first radiating portion with the ground portion on and a second connecting portion (25) connecting the first radiating portion and the second radiating portion. The second radiating portion symmetrically forms a pair of arms (221, 222). The feeder includes an inner core (41) connecting to the second connecting portion and an outer shield (42) connecting to the ground portion.

16 Claims, 6 Drawing Sheets

DUAL BAND ANTENNA FOR WIRELESS COMMUNICATION

BACKGROUND OF THE INVENTION

1. Field of the Invention

The present invention relates in general to antenna structures, and in particular to a dual band antenna structure in a wireless communication device.

2. Description of the Prior Art

The development of wireless local area network (WLAN) technology has been attended by the development of devices operating under the IEEE 802.11b standard (in the 2.45 GHz band) and the IEEE 802.11a standard (in the 5.25 GHz band). These devices benefit from dual band antennas.

U.S. Pat. No. 6,204,819 discloses a conventional dual-band antenna. The dual-band antenna includes a first and second conductive branches and is provided for use within wireless communications devices, such as radiotelephones. The first conductive branch has a first and second feeds extending therefrom that terminate respectively at a first and second micro-electromechanical systems (MEMS) switches S1, S2. The second conductive branch is in adjacent, spaced-apart relationship with the first conductive branch. One end of the second conductive branch terminates at a third MEMS switch S3 and the opposite end of the second conductive branch is connected to the first conductive branch via a fourth MEMS switch S4. The fourth MEMS switch S4 is configured to be selectively closed to electrically connect the first and second conductive branches such that the antenna radiates as a loop antenna in a first frequency band. The fourth switch S4 is also configured to open to electrically isolate the first and second conductive branches such that the antenna radiates as an inverted-F antenna in a second frequency band different from the first frequency band. However, the three dimensional structure of the antenna occupies a large space, which is counter to the trend toward miniaturization of portable electronic devices. Furthermore, the antenna adopts the switches to select two different frequency bands, which adds manufacturing cost and complexity of the antenna.

Hence, an improved antenna is desired to overcome the above-mentioned disadvantages of the prior art.

BRIEF SUMMARY OF THE INVENTION

A primary object of the present invention is to provide a dual band antenna with a simple structure for reducing manufacturing cost.

Another object of the present invention is to provide a dual band antenna occupying smaller space.

A dual band antenna for a wireless communication device includes an insulative substrate, a feeder and a conductive element disposed on the substrate includes a ground portion, a first radiating portion, a second radiating portion, a first connecting portion connecting the first radiating portion with the ground portion and a second connecting portion connecting the first radiating portion and the second radiating portion. The second radiating portion symmetrically forms a pair of arms. The feeder includes an inner core connecting to the second connecting portion and an outer shield connecting to the ground portion. The first radiating portion, the first and second connecting portions, the ground portion and the feeder together constitute a planar inverted-F antenna (PIFA), which operates at a lower frequency band. The second radiating portion is adapted for operating at a higher frequency band and adjusting the operating bandwidth and the matching impedance at the higher frequency band.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
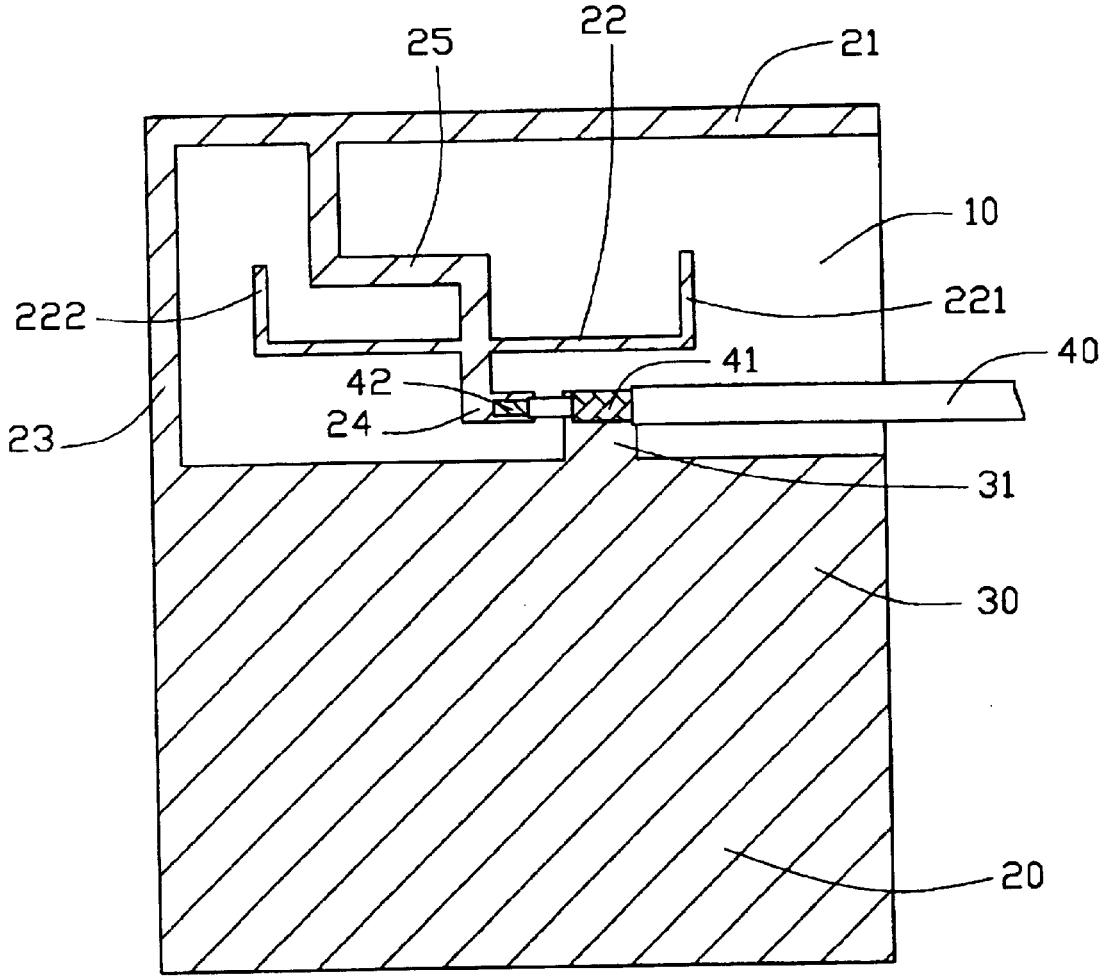
FIG. 1 is a plan view of a dual band antenna in accordance with the present invention.
Figure 2:
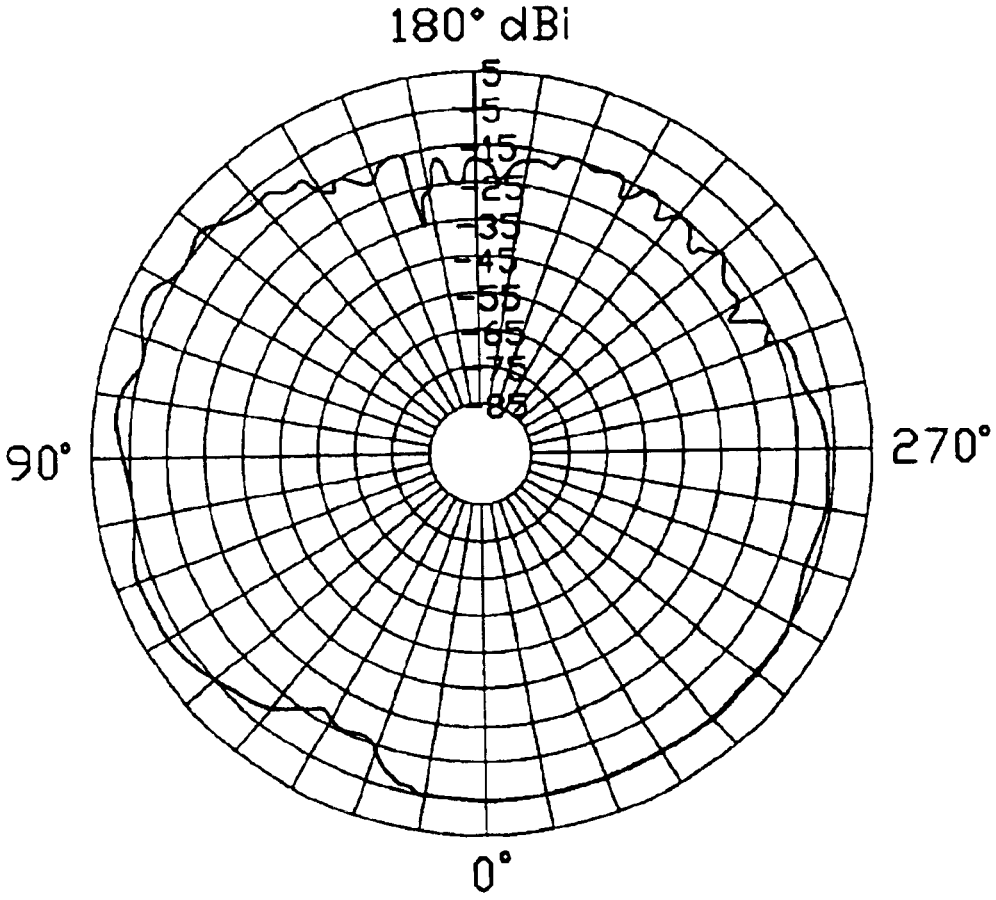
FIG. 2 is a horizontally polarized principle plane radiation pattern of the dual band antenna of FIG. 1 operating at a frequency of 2.45 GHz.
Figure 3:
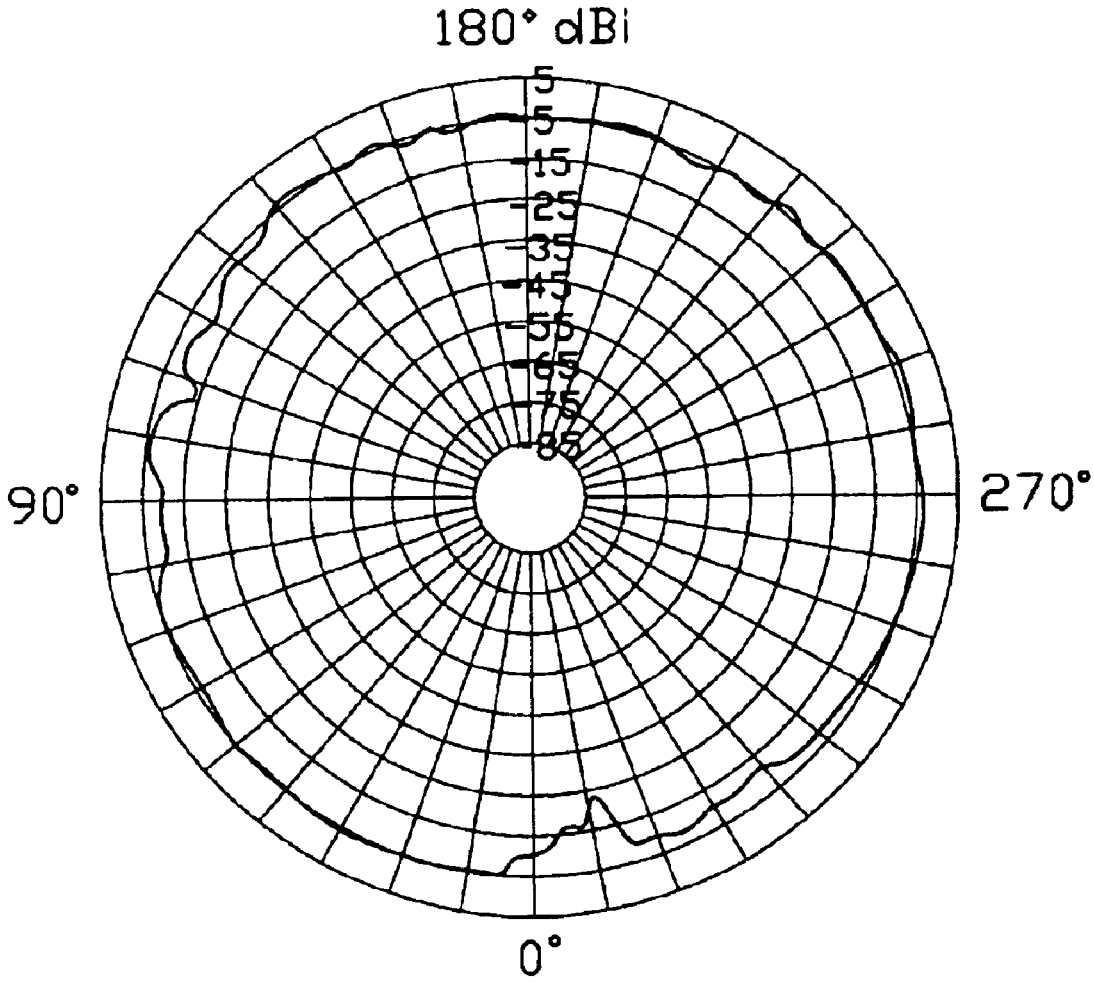
FIG. 3 is a vertically polarized principle plane radiation pattern of the dual band antenna of FIG. 1 operating at a frequency of 2.45 GHz.
Figure 4:
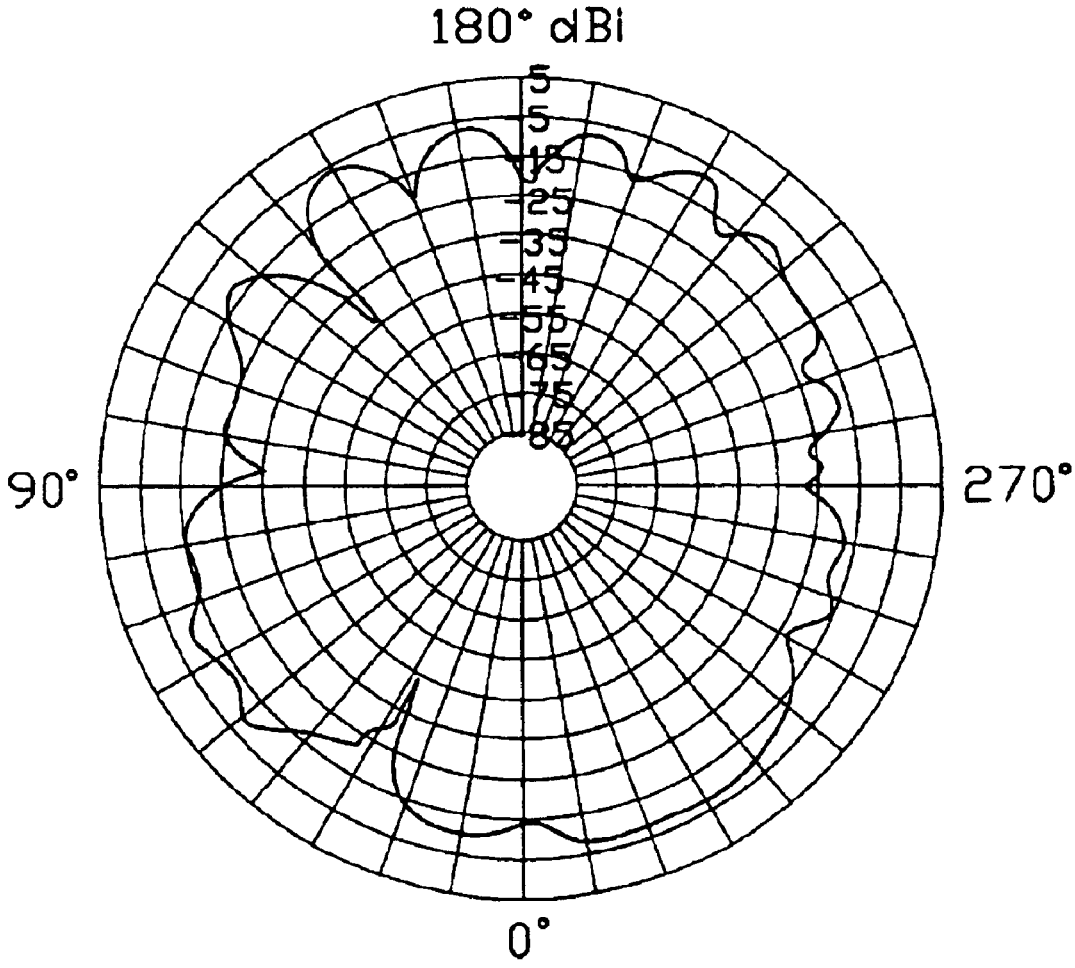
FIG. 4 is a horizontally polarized principle plane radiation pattern of the dual band antenna of FIG. 1 operating at a frequency of 5.35 GHz.
Figure 5:
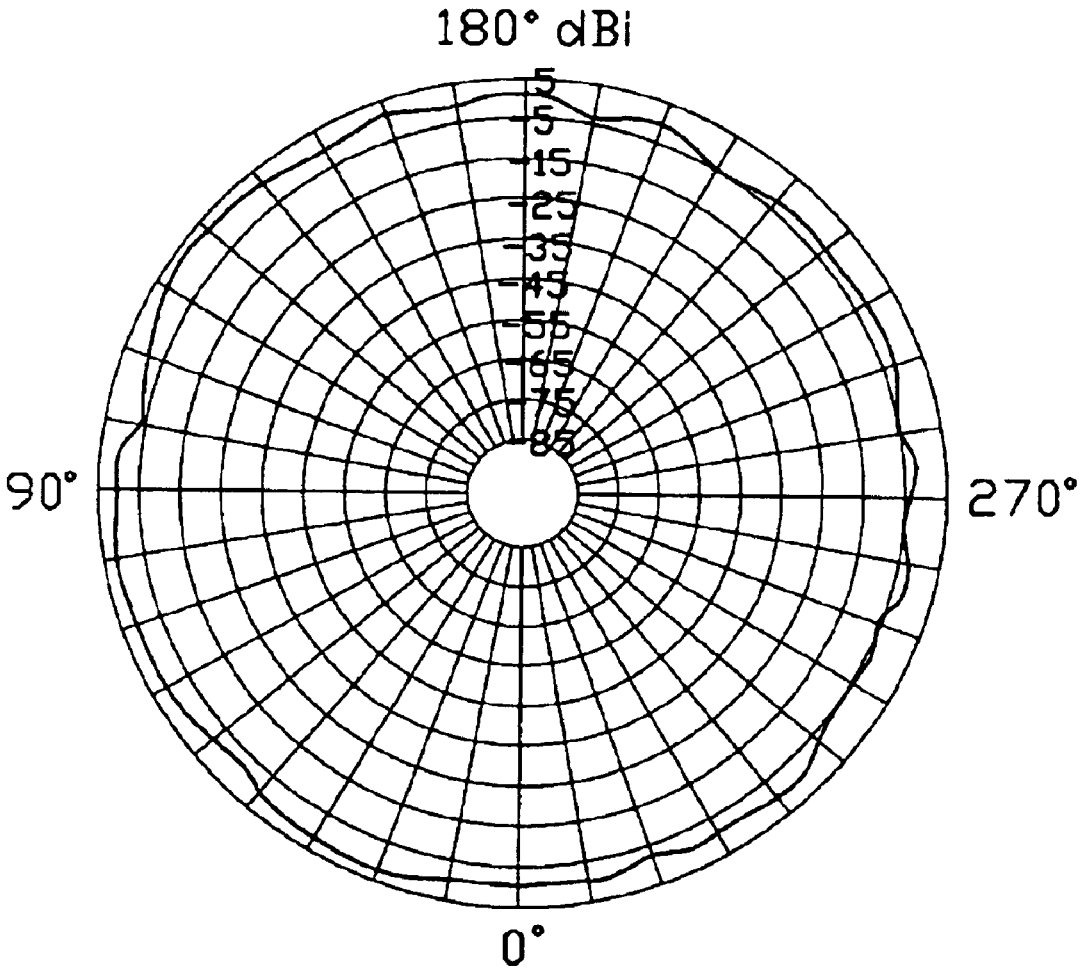
FIG. 5 is a vertically polarized principle plane radiation pattern of the dual band antenna of FIG. 1 operating at a frequency of 5.35 GHz.

Referring to FIG. 1, a dual band antenna 1 in accordance with a preferred embodiment of the present invention comprises a planar insulative substrate 10, a conductive element 20 attached to the substrate 10 and a feeder 40 connected to the conductive element 20.

The conductive element 20 can be a metal plate or a conductive layer disposed on one surface of the substrate 10 and includes a planar ground portion 30, a first radiating portion 21, a second radiating portion 22, a first connecting portion 23 and a second connecting portion 25. The first connecting portion 23 connects a distal end of the first radiating portion 21 with a distal end of the ground portion 30. The first radiating portion 21 and the first connecting portion 23 form an L-shaped structure. The second connecting portion 25 has a step structure and connects a middle portion of the first radiating portion 21 with the second radiating portion 22. The second radiating portion 22 includes a pair of L-shaped arms 221, 222 symmetrically extending from two opposite sides of the second connecting portion 25. The ground portion 30 has a projection 31 extending upwardly therefrom. The second connecting portion 25 forms a feed portion 24 on a free end thereof.

The feeder 40 is a coaxial cable and comprises a conductive inner core 41, an inner dielectric layer (not labeled) around the inner core 41, a conductive outer shield 42 around the inner dielectric layer, and an outer dielectric layer (not labeled) around the conductive outer shield 42. A portion of the outer dielectric layer is stripped off to expose the outer shield 42, and a portion of the outer shield 42 and the inner dielectric layer is stripped off to expose a length of the inner core 41. The inner core 41 is soldered onto the feed portion 24, and the outer shield 42 is soldered onto the projection 31.

The first radiating portion 21, the first and second connecting portions 23 and 25, the projection 31, the ground portion 30 and the feeder 40 together constitute a PIFA, which operates at a lower frequency band. The second radiating portion 22 is adapted for operating at a higher frequency band. The dimension and location on the connecting portion 25 of the second radiating portion 22 could be adjusted to control the operating bandwidth and the matching impedance at the higher frequency band.

Referring to FIGS. 2 to 5, the figures respectively show horizontally and vertically polarized principle plane radiation patterns of the dual band antenna 1, which are tested respectively at the frequencies 2.45 GHz and 5.35 GHz. Note that each radiation pattern is close to a corresponding optimal radiation pattern and there is no obvious radiating blind area.

Figure 6:
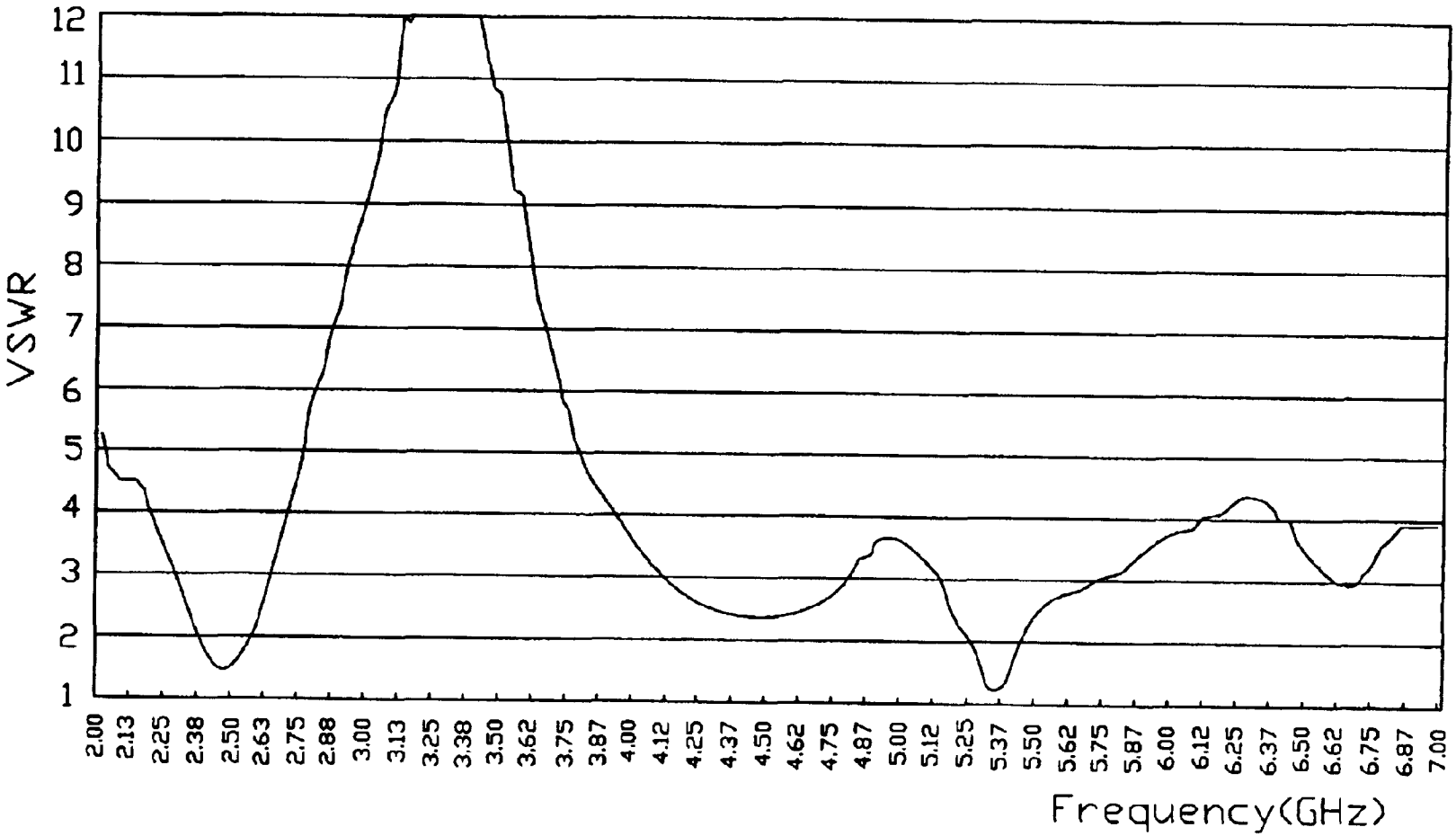
FIG. 6 is a test chart recording for the dual band antenna of FIG. 1, showing Voltage Standing Wave Ratio (VSWR) as a function of frequency.

FIG. 6 shows a test chart recording of Voltage Standing Wave Ratio (VSWR) of the dual band antenna 1 as a function of frequency. Note that VSWR drops below the desirable maximum value "2" in the 2.4–2.5 GHz frequency band and in the 5.25–5.45 GHz frequency band, indicating acceptably efficient operation in these two wide frequency bands.

The planar structure of the dual band antenna 1 of the present invention has a simple structure to manufacture. Furthermore, the dual band antenna 1 with a planar structure will occupy smaller space than three dimensional structures of the prior arts, which achieves an efficiency of miniaturization.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A dual band antenna adapted for a wireless communication device, comprising:

an insulative substrate;

a conductive element disposed on the substrate, the conductive element including a ground portion, a first radiating portion, a second radiating portion, a first connecting portion connecting the first radiating portion with the ground portion and a second connecting portion connecting the first radiating portion and the second radiating portion, the second radiating portion having a pair of arms; and a feeder including an inner core connecting to the second connecting portion and an outer shield connecting to the ground portion.

2. The dual band antenna as claimed in claim 1, wherein the first radiating portion, the first and second connecting portions, the ground portion and the feeder together constitute a PIFA.

3. The dual band antenna as claimed in claim 2, wherein each arm of the second radiating portion has an L-shaped structure and is disposed symmetrically at two opposite sides of the second connecting portion.

4. The dual band antenna as claimed in claim 3, wherein the PIFA operates at a lower frequency band, and the second radiating portion operates at a higher frequency band.

5. The dual band antenna as claimed in claim 1, wherein the second connecting portion has a feed portion on a free end thereof, and the inner core of the feeder is connected to the feed portion.

6. The dual band antenna as claimed in claim 1, wherein the ground portion has a projection, and the outer shield of the feeder is connected to the projection.

7. A dual band antenna comprising:

an insulative substrate;

a conductive element formed on the substrate and including:

a ground portion;

a first radiating portion spaced from the ground portion;

a first connecting portion connected between the first radiating portion and the ground portion;

a second radiating portion located between said ground portion and said first radiating portion;

a second connecting portion spaced from the first connecting portion and mainly connected between the first radiating portion and the second radiating portion;

a feed portion extending around an end of the second connecting portion close to the ground portion; and a feeder including an inner core connecting to the feed portion and an outer core connecting to the ground portion.

8. The antenna as claimed in claim 7, wherein said second radiating portion includes two arms respectively extending on two sides of said second connecting portion symmetrically.

9. The antenna as claimed in claim 8, wherein said two arms are of an L-shaped configuration.

10. The antenna as claimed in claim 9, wherein said L-shaped configuration extends toward the first radiating portion and away from the ground portion.

11. The antenna as claimed in claim 7, wherein said outer core is connected to a projecting portion which extends toward the second radiating portion from a main body of the ground portion.

12. The antenna as claimed in claim 11, wherein said feeder essentially extends along a direction parallel to the first radiating portion.

13. A dual band antenna comprising:

an insulative substrate;

a conductive element formed on the substrate and including:

a ground portion;

a first radiating portion spaced from the ground portion in a parallel relation;

a second radiating portion located between said ground portion and said first radiating portion;

a Z-like connecting portion connected between the first radiating portion and the second radiating portion;

a feed portion extending around an end of the connecting portion and close to the ground portion;

a projection extending from a main body of the ground portion toward the second radiating portion; and a feeder including an inner core connecting to the feed portion and an outer core connecting to the projection; wherein said feed portion and said projection cooperate with said feeder to form another Z-like connection between the ground portion and the second radiating portion.

14. The antenna as claimed in claim 13, wherein said Z-like connecting portion and said Z-like connection commonly form a multiple steps structure thereof.

15. The antenna as claimed in claim 14, wherein said second radiating portion is of a U-shaped configuration which is symmetrically intersected with said multiple steps structure.

16. The antenna as claimed in claim 15, wherein said U-shaped configuration faces the first radiating portion.

* * * * *